United States Patent [19]

Sandell et al.

[11] 4,239,397

[45] Dec. 16, 1980

[54] METHOD FOR MANUFACTURING SHOTCRETE STRUCTURES USING A MATERIAL HAVING HIGH IMPACT RESISTANCE AND OPTIMUM DEFORMATION PROPERTIES

[76] Inventors: Bertil Sandell, Hovås, Hovås, Sweden, 430 80; Göte Liljegren, Myntvägen 22, Växjö, Sweden

[21] Appl. No.: 944,312

[22] Filed: Sep. 21, 1978

Related U.S. Application Data

[63] Continuation of Ser. No. 790,389, Apr. 25, 1977, abandoned, which is a continuation-in-part of Ser. No. 600,079, Jul. 29, 1975, abandoned.

[30] Foreign Application Priority Data

Aug. 2, 1974 [SE] Sweden ..... 7409963

[51] Int. Cl.[3] ..... B05D 1/12

[52] U.S. Cl. ..... 366/3; 239/427; 239/430; 366/11; 366/40; 427/426; 427/427

[58] Field of Search ..... 234/10, 554, 419.3, 234/424, 422, 427, 428, 430, 431; 427/196, 426, 427; 366/5, 10, 11, 40

[56] References Cited

U.S. PATENT DOCUMENTS

| | | | |
|---|---|---|---|
| 1,346,638 | 7/1920 | Crook et al. | 427/427 X |
| 1,595,362 | 8/1926 | Schaefer | 427/426 |
| 2,176,891 | 10/1939 | Crom | 264/309 X |
| 2,495,540 | 1/1950 | Nichols et al. | 427/426 X |
| 2,504,805 | 4/1950 | Clipson | 427/427 X |
| 2,683,625 | 7/1954 | Fisher | 427/426 X |
| 3,093,505 | 6/1963 | Conway | 427/427 |
| 3,211,253 | 10/1965 | Gonzalez | 427/426 X |
| 3,289,371 | 12/1966 | Pearson et al. | 264/309 X |
| 3,730,763 | 5/1973 | Schlottmann et al. | 427/427 X |
| 3,912,838 | 10/1975 | Kraus et al. | 427/426 |
| 3,930,061 | 12/1975 | Scharfenberger | 427/426 X |
| 4,022,439 | 5/1977 | Groth | 366/50 X |

FOREIGN PATENT DOCUMENTS

| | | | |
|---|---|---|---|
| 1646890 | 8/1972 | Fed. Rep. of Germany | 427/427 |

*Primary Examiner*—Shrive P. Beck
*Attorney, Agent, or Firm*—Holman & Stern

[57] ABSTRACT

The invention refers to fibre reinforced shotcrete and it more particularly resides in an improved method for manufacturing structures of such concrete by means of shotcrete. According to the new method a dry mixture of a binding agent and ballast is supplied with chopped fibrous reinforcing material through a feed opening located in the spraying nozzle of the spraying apparatus upstream from the position in which water is added to the mixture.

7 Claims, 3 Drawing Figures

METHOD FOR MANUFACTURING SHOTCRETE STRUCTURES USING A MATERIAL HAVING HIGH IMPACT RESISTANCE AND OPTIMUM DEFORMATION PROPERTIES

This is a continuation of applicatiion Ser. No. 790,389, filed Apr. 25, 1977 now abandoned which in turn is a continuation-in-part of Application Ser. No. 600,079, filed July 29, 1975 now abandoned.

BACKGROUND OF THE INVENTION

This invention relates to a method for manufacture of shotcrete structures utilizing shorcreting practices to provide structures having high impact resistance and optimum deformation properties (slight shrinkage and creep tendencies, reduced crack formation and improved crack dispersion) by means of shotcreting, in which a dry mixture of a binding agent and a ballast material is carried in an air stream through a first tubing to a spraying nozzle in which water is added to said mixture.

The term shotcreting means the introduction of a dry, pneumatically conveyed mixture of a binding agent and a ballast material to nozzle, where water is added. The water-cement ratio is much lower than for ordinary concrete, about 0.3–0.4, which means that the mixture leaving the nozzle is relatively dry. This shotcrete mixture leaves the nozzle at a very high velocity. The ratio dry material—air is as low as about 0.01.

Attempts have earlier been made to reinforce shotcrete materials with fibres. The orientation and location of the fibres in the concrete is an essential factor. A number of different mixting methods have been developed, but none of these has proved to be acceptable in practice, due to difficulties in distribution of said fibres. The fibres cluster into large units, which will be located in the bottom layer of the structure due to their heaviness. The mixing of fiber shotcrete is made difficult thereby that the result is heavily dependent on the type of fibrous material used the quantity of the fibrous material and the length and thickness respectively of the individual fibres.

Attempts carried out with admixture of fibres in concrete have shown that considerably improved properties can be achieved for the concrete material, if the alignment and the distribution of the fibres can be controlled.

Earlier has been proposed (U.S. Pat. No. 3,289,371) a method of applying a gypsum slurry, to which is added to reinforcing material, onto a surface. This slurry is pumped through the nozzle at a low velocity, as compared to shotcreting where the mixture is pneumatically conveyed at a high speed. The air content is 0 (compared to a shotcrete mixture, where the air content is about 0.99), and reinforcing glass fibers are introduced to the slurry either after the outlet of the nozzle or immediately before the outlet. The introduction of the reinforcing fibers downstream of the outlet of the nozzle will not afford sufficient mixing of fibers with a slurry, but the reinforcement is preferably concentrated in the upper stratum of the gypsum.

The introduction of reinforcing fibers immediately before the outlet of the nozzle would not function at all, since the slurry would probably plug up the outlet of the nozzle, because the smaller cross section area available of the axially introduced tube or nozzle.

If an introduction of reinforcement fibers were effected immediately before the outlet of a shotcrete nozzle, the fibers tend to concentrate in the middle of the stream leaving the nozzle. Some mixing of the fibers with the shotcrete mixture would of course take place in the areas between the inner fiber stream and the outer shotcrete mixture stream, but there would be no homogeneous mixing in the entire stream.

SUMMARY OF THE INVENTION

The purpose of the invention is to provide a method by which the clustering of the fibres is substantially eliminated and by which a more homogenous mixture can be obtained, and this has been achieved with a method comprising in combination the steps of:

A. pneumatically conveying a dry mixture of a water-activatable, binding agent and ballast material to an application nozzle having an outlet;

B. introducing water into the application nozzle upstream of the nozzle outlet and activating the binding agent in the mixture, which is to be pneumatically projected at a high velocity onto a surface; the improvement comprising:

C. introducing into the application nozzle upstream of where the water is introduced into the application nozzle a fibrous reinforcing material; and D. spraying the activated mixture of water-activated binding material, ballast material and fibrous reinforcing material onto a portion of a shotcrete structure being produced.

Fiber reinforced shotcrete can with advantage be used for example when reinforcing ceilings and walls of tunnels, drainage canals, tubes, or thin-walled shell structures. An improved energy absorbing ability is obtained with such applications, i.e. the impact resistance increases, and also the toughness. The fibrous material, which has a high tensile strength and a high coefficient of elasticity, can with advantage be used when manufacturing tubes, or moulds intended to be a permanent part of the structure. If there is no need to consider the tensile strength of the manufactured elements, fibres of polypropylene can be used with advantage, and this results in a highly improved impact resistance. Other types of fibrous materials can also be used, e.g. natural or synthetic textile fibres.

Comparative tests have been made to establish whether or not the method now claimed is superior to the method described in the above-mentioned U.S. patent specification when utilized for shotcreting.

When applying shotcrete, the ratio between the material which will adhere to the base and the material, which will rebound therefrom is significant, and the content of reinforcing fibres of essential importance. The above-mentioned comparative tests have shown that the method according to the present application gave 35% by weight of rebounding reinforcing material, whereas the method according to the aforesaid U.S. patent specification gave 75% by weight of rebounding reinforcing material.

This result is considered clearly to indicate that the method according to the present application will give a much more homogenous mixture of shotcrete and reinforcing fibres than the earlier known comparable methods.

BRIEF DESCRIPTION OF THE DRAWINGS

The attached drawings show schematically, how the method can be accomplished in order to render shotcreting of fiber reinforced concrete structures possible.

DESCRIPTION OF THE PREFERRED EMBODIMENTS

Figure 1:
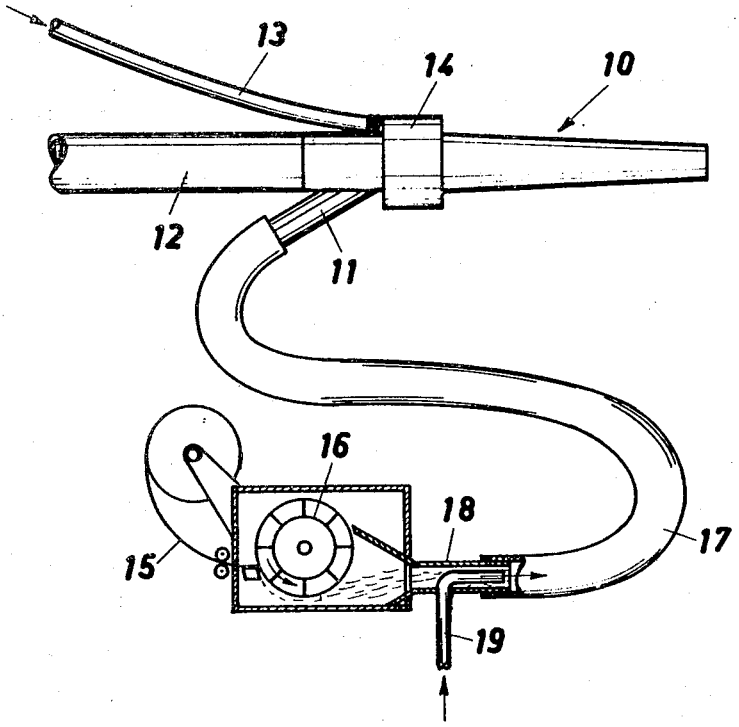
FIG. 1 shows in a schematic side elevation partly in section an embodiment of a shotcreting nozzle together with a device for the introduction of the reinforcing fibres.

FIG. 1 shows a shotcreting nozzle 10 which, with the exception of a connection or pipe socket 11, can be a nozzle of conventional type in this field. A pliable tube or tubing 12 is provided for supplying a mixture of a binding agent, e.g. cement, lime, gypsum or the like, and ballast such as sand by means of an air stream to the nozzle, and water is added to the mixture of e.g. cement and sand via a pipe 13 connected to an annular passage 14 in the nozzle 10.

The reinforcing material 15, which for instance is wound on a cylinder or is lying free, is brought through a cutter device 16 where it is cut into suitable lengths. The chopped fibres can have a length of up to about 50 mm. FIG. 1 shows a type of cutter, where band- or thread-shaped reinforcing material is unwound from a storage cylinder via a pair of feed rollers and it is from there fed to a rotor, provided with cutting teeth along its circumference. By varying the speed of the rotor, the number and the positions of the cutting teeth, or the speed of the pair of feed rollers it is possible to cut off different, desired lengths of the reinforcing material. The cutting teeth will also act as fan blades effecting the chopped reinforcing material to be blown to a feed opening provided in a tubing 17. The pliable tube or tubing 17 is connected between the pipe socket 11 of the nozzle 10 and a connection member 18. The end of a tube 19 intended for connection to a source of compressed air, extends into the connection member 18 and possibly also into the pliable tube 17, and it is introduced so far that the compressed air when introduced through the tube 19, will suck the chopped reinforcing material into the pliable tube 17 by ejector action and the fibres are introduced into the concrete in the nozzle 10 by means of the air stream. The quantity of the fibrous material in the shotcrete can be varied and the content of fibrous material can be as high as up to a few percent of volume.

Attempts have shown that such a distribution of the fibres is obtained when using a shotcreting nozzle of the type described that the individual fibres will be located in planes substantially parallel to the surface or the frame on which the shotcrete is applied, and with that a high impact resistance is obtained.

The pipe socket 11 for introducing the reinforcing fibres is arranged so that the reinforcing material is mixed into the binder- and ballast mixture before water is added. This can be accomplished since the mixture conveyed in th pliable tube 12 is carried by an air stream and is not forming a compact pillar in the tube 12. As the reinforcing fibres are introduced in a dry flow of material there is substantially no risk that the mixture will plug up the nozzle.

Figure 2:
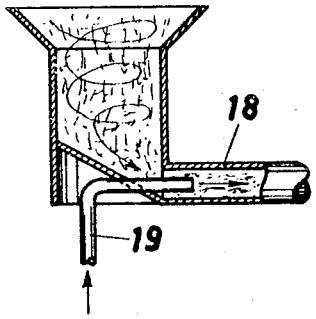
FIG. 2 shows in cross-section a side elevation of a modified fiber introducting device.

In cases where already chopped reinforcing material is used, a vibration and orientation device of the kind schematically shown in FIG. 2 can be used instead of the cutter device shown in FIG. 1. The reinforcing material, which in this case can be pieces of steel wire of suitable length, is brouht into a funnel-shaped container, whereby the container or a part therof is vibrated so that the pieces of wire are brought against an oblique plate where they are oriented in a direction towards an opening defind by a connection member. The pieces of wire are brought through a pliable tubing and into the shotcrete nozzle in the same manner as described in the previous embodiment.

Figure 3:
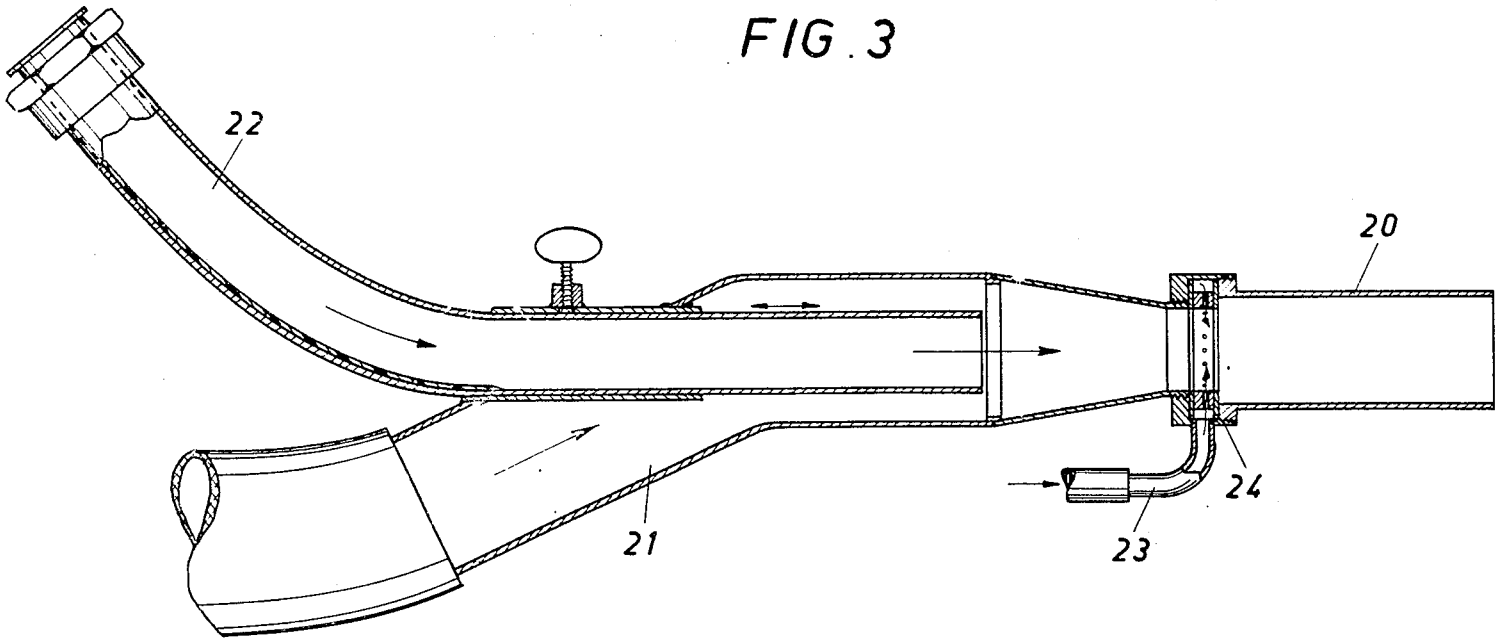
FIG. 3 is a partly sectioned side elevation of a modified shotcreting nozzle for use in carrying out the invention.

FIG. 3 shows in a partially section side view a somewhwat modified shotcreting nozzle.

The nozzle 20 is connected to a coarse hose 21 through which fibres of reinforcing material is supplied to a mixing chamber by means of compressed air. A conduit 22 for introduction of a premixed, dry compound of a binding agent and a ballast material is conveyed pneumatically to the mixing chamber where it is introduced tangentially into the flow of reinforcing material.

The conduit 22 is as shown preferably fitted to a socket, which is adjustably mounted in the wall of the mixing chamber of the nozzle, and it is thereby possible to adjust the position of mixing between binder/ballast and reinforcing material axially in the mixing chamber.

The nozzle 20 is further provided with an annular nozzle 24 through which water which is supplied via a duct 23 is introduced radially into the shotcreting nozzle 20 downstream of the point where conduit 22 opens in the mixing chamber and as short distance before the opening of the shotcreting nozzle 20.

Since the chopped reinforcing material by utilizing the shotcreting method according to the invention will be oriented in parallel with the surface being sprayed, the method according to the invention is particularly suitable for production of thin concrete structures, which because of said orientatiion will obtain high impact resistance.

We claim:

1. In a method of manufacturing shotcrete structures using a material having high impact resistance and optimum deformation properties, comprising in combination the steps of:

A. pneumatically conveying a dry mixture of a water-activatable, binding agent and ballast material to an application nozzle having an outlet, B. mixing said dry mixture with a fibrous reinforcing material, C. introducing water into the application nozzle upstream of the nozzle outlet and activating the binding agent in the mixture which is to be pneumatically projected at a high velocity on to a surface, and D. spraying the activated mixture of water activated binding material, ballast material and fibrous reinforcing material onto a portion of a shotcrete structure being produced, the improvement comprising:

E. introducing said dry mixture and said fibrous reinforcing material into the application nozzle in separate independent streams and effecting the mixing of said dry mixture with said fibrous reinforcing material within the application nozzle upstream of where the water is introduced into the application nozzle.

2. The method for manufacturing concrete structures as claimed in claim 1 including providing the reinforcing material as a continuous length, and chopping the reinforcing material while directing the material to the application nozzle.

3. The method for manufacturing concrete structures as claimed in claim 2 including providing the reinforcing material as a plastic fiber.

4. The method for manufacturing concrete structures as claimed in claim 2 wherein the reinforcing material is a metallic material.

5. The method for manufacturing concrete structures as claimed in claim 1 including directing the reinforcing material to said application nozzle under pressure to ensure mixing of the reinforcing material in the activated mixture.

6. A method for manufacturing concrete structures as claimed in claim 1 including applying the mixture of binding agent, ballast material and reinforcing material so that the reinforcing material will be disposed in a primary direction generally parallel to the surface upon which the activated mixture is being deposited.

7. The method for manufacturing concrete structures as claimed in claim 1 comprising using cement as a binding agent and sand as the ballast material.

* * * * *